US010981402B2

(12) United States Patent
Ramsey

(10) Patent No.: US 10,981,402 B2
(45) Date of Patent: Apr. 20, 2021

(54) MARKING TABS WITH A TWO DIMENSIONAL CODE

(71) Applicant: Crown Packaging Technology, Inc., Alsip, IL (US)

(72) Inventor: Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 40 days.

(21) Appl. No.: 15/154,191

(22) Filed: May 13, 2016

(65) Prior Publication Data

US 2016/0332772 A1 Nov. 17, 2016

Related U.S. Application Data

(60) Provisional application No. 62/160,769, filed on May 13, 2015.

(51) Int. Cl.

| | |
|---|---|
| ***B41J 3/407*** | (2006.01) |
| ***B41M 5/28*** | (2006.01) |
| ***B65D 17/28*** | (2006.01) |

(52) U.S. Cl.

CPC ..... *B41M 5/28* (2013.01); *B65D 17/4012* (2018.01); *B65D 2203/06* (2013.01)

(58) Field of Classification Search

CPC ... B41M 5/28; B65D 17/4012; B65D 2203/06
See application file for complete search history.

(56) References Cited

U.S. PATENT DOCUMENTS

| | | | | |
|---|---|---|---|---|
| 4,733,793 | A | 3/1988 | Moen | |
| 4,860,226 | A * | 8/1989 | Martin | G06K 5/00 702/82 |
| 5,219,257 | A | 6/1993 | Koch | |
| 5,632,916 | A | 5/1997 | Lappalainen et al. | |
| 6,105,806 | A | 8/2000 | Stasiuk | |
| D444,385 | S | 7/2001 | Dixon | |
| 6,498,318 | B1 | 12/2002 | Miller et al. | |
| 6,691,919 | B1 * | 2/2004 | Katz | G06K 7/10881 235/462.01 |
| D570,228 | S | 6/2008 | Van Dam | |
| D605,060 | S | 12/2009 | Reimer | |
| D632,588 | S | 2/2011 | George | |

(Continued)

FOREIGN PATENT DOCUMENTS

| | | | |
|---|---|---|---|
| CN | 103764337 | A | 4/2014 |
| CO | 6920277 | A2 | 4/2014 |

(Continued)

*Primary Examiner* — Gordon Baldwin
*Assistant Examiner* — Christina D McClure
(74) *Attorney, Agent, or Firm* — BakerHostetler

(57) ABSTRACT

A method for forming a Data Matrix Code or like two dimensional code on a beverage can tab uses a laser having a focal ratio of between 40 and 70 to produce spots having an average diameter of between 200 and 400 microns. The code is smaller than 6 mm by 6 mm, at least 12 modules by 12 modules, and smaller than 21 modules by 21 modules, thereby providing sufficient quantity of unique codes for use with commercial beverage can quantities. Preferably each module is formed by one laser spot. Alternatively, nine spots may be used to form a module.

15 Claims, 4 Drawing Sheets

(56) References Cited

U.S. PATENT DOCUMENTS

| | | | | |
|---|---|---|---|---|
| D641,644 | S | 7/2011 | George | |
| D693,698 | S | 11/2013 | Miller, Jr. | |
| D704,555 | S | 5/2014 | Hernandez | |
| D706,032 | S | 6/2014 | Roth | |
| D713,268 | S | 9/2014 | Jones | |
| D732,402 | S | 6/2015 | Jones | |
| 9,187,221 | B2 | 11/2015 | Ramsey et al. | |
| 9,278,776 | B2 | 3/2016 | Ramsey | |
| 2003/0044582 | A1* | 3/2003 | Sakoske | B41M 1/12 428/195.1 |
| 2005/0045637 | A1 | 3/2005 | Rohr et al. | |
| 2008/0295558 | A1 | 12/2008 | Reimer | |
| 2011/0193928 | A1* | 8/2011 | Zhang | B41J 2/442 347/224 |
| 2012/0100348 | A1* | 4/2012 | Brookhyser | B23K 26/063 428/195.1 |
| 2012/0187184 | A1* | 7/2012 | Challa | G06K 19/06112 235/375 |
| 2012/0306189 | A1 | 12/2012 | Stewart et al. | |
| 2013/0075296 | A1 | 3/2013 | Ramsey | |
| 2013/0270269 | A1* | 10/2013 | Lewis | B41M 5/24 220/270 |
| 2014/0063566 | A1* | 3/2014 | Naito | H04N 1/203 358/474 |
| 2014/0084003 | A1* | 3/2014 | Ramsey | B65B 43/00 220/270 |
| 2016/0249647 | A1* | 9/2016 | Cuny | A21C 15/00 426/237 |

FOREIGN PATENT DOCUMENTS

| | | | | |
|---|---|---|---|---|
| JP | 2005106866 | A | 4/2005 | |
| JP | 2011016546 | A | 1/2011 | |
| JP | 2011-020701 | A | 2/2011 | |
| JP | 2014188518 | A | 10/2014 | |
| WO | 11101673 | A2 | 8/2011 | |
| WO | WO 2014/150647 | A1 | 9/2014 | |
| WO | WO-2014206977 | A1 * | 12/2014 | B42D 25/00 |
| WO | 2014007807 | A1 | 1/2015 | |
| WO | WO-2015001235 | A1 * | 1/2015 | A21C 15/00 |

* cited by examiner

Fig. 3 Production trials
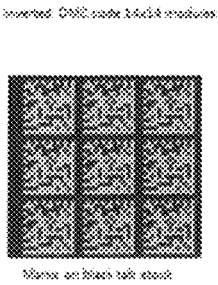
Figure 2
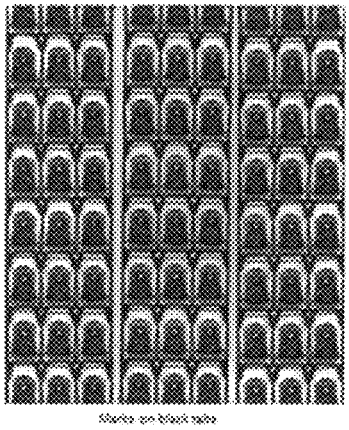
Fig 4. Ablation marking microscopy
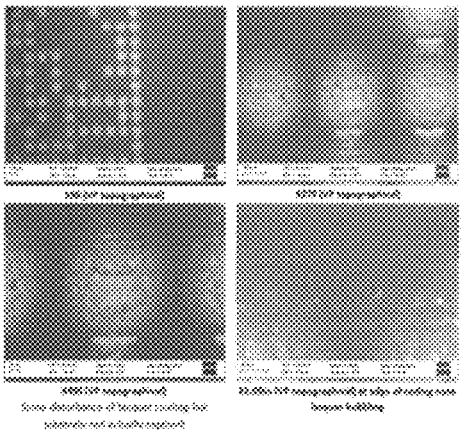

MARKING TABS WITH A TWO DIMENSIONAL CODE

CROSS REFERENCE TO RELATED APPLICATIONS

This application claims the benefit of Provisional U.S. Patent Application No. 62/160,769 filed on May 13, 2015, and entitled "MARKING TABS WITH A TWO DIMENSIONAL CODE," the content of which is incorporated by reference herein in its entirety.

FIELD OF THE INVENTION

This invention relates to containers, and more particularly to metal containers and beverages and producing markings on same.

BACKGROUND

Two piece metal beverage cans include a can body on which a can end is attached by a seam. Commercial two piece beverage cans are formed by a drawing and ironing process that forms the body sidewall integral with the base. Three piece metal cans include a cylindrical body, each end of which has a can end attached by a seam.

Two piece beverage cans are produced in vast quantities for beverages and foods use; three piece beverage cans are produced in vast quantities for food uses. Accordingly, the components of the cans must be produced at high speeds.

Conventional beverage cans and many easy open food cans have pull tabs. Pull tabs are formed from metal sheet in a tab press. Because of the quantities required, conventional tab presses form multiple tabs at once in lanes of two, three, or four tabs.

Typically, a pre-lacquered sheet of aluminum is fed from a coil into a shell press to form the can end shells. A pre-lacquered strip of aluminum is fed from a coil into a tab press to form the pull tabs. The shells and pull tabs are combined in a conversion press to form the unseamed can end.

Decoration of can ends, especially pull tabs, is known. For example, U.S. Pat. No. 6,105,806 discloses laser etching or removal of portions of a coating on a pull tab. U.S. Pat. No. 6,498,318 acknowledges difficulties in marking metal cans and discloses ablating metal pull tab stock.

U.S. Pat. No. 9,187,221 discloses marking on a can end and tab of a two dimensional code by applying a laser to the coated substrate to change an appearance of at least a portion of a photonically active component substantially without burning, etching, or ablating the lacquer, thereby forming an image. Preferably, a CO2 laser is employed that has a beam width that is less than approximately 50 microns, more preferably no more than approximately 30 microns, more preferably no more than approximately 10 microns, and preferably approximately 5 microns. Accordingly the image may be formed by dots that have a dimension of less than approximately 50 microns, preferably no more than approximately 30 microns, more preferably no more than approximately 10 microns, and preferably approximately 5 microns. Accordingly the image may be formed by dots that have a dimension of less than approximately 50 microns.

JP 2011 020701 (Taguchi) discloses marking on a flap that is separated from the structural portion of the tab by fold lines. After marking is applied to the flap, it is folded over the structural portion of the tab to form a cover.

QR codes are the most frequently used code type for applications that are read by smartphone scanning software. Conventional QR codes take in excess of 200 ms to write by conventional laser marking.

The inventors are aware of a commercial, conventional system for laser etching pull tabs that includes a CO2 laser that often operates at about 100 W. Each lane of a tab press has its own laser such that the tab press can operate at about 700 tabs per minute with a laser having a resolution or dimension of approximately 100 microns. Typically, a dark colored lacquer is removed by the laser to expose bare aluminum in the form of a simple logo or a few characters. The limitation on the process speed is also a limitation on the amount of decoration.

Laser marking of coatings is employed for flexible and card packaging for various marking applications. Typically, a thermally active pigment is loaded into a transparent or light colored lacquer, and a CO2 laser induces a color change. For example, a laser may be applied to a white lacquer label to display black text. Laser marking systems of this type are available from Sun Chemical, under the trade name Sunlase and employ a 100 micron YAG laser.

Conventional laser application to tab or other metal can substrates usually require a very high beam intensity and thus the use of high powered fibre lasers, for example 20 W or 40 W with a small focal length, for example 180 mm in order to etch a coating or metal substrate. As a result, the laser markings usually have characteristic dimensions of much less than 200 microns, typically only 50 to 150 microns.

SUMMARY

A method for marking a code on a beverage can tab structure can include a combination of spot size (for forming an element of a two dimensional code), code area, matrix size (that is, number of elements), speed of forming the code, and code readability to achieve a commercial viable method that provides sufficient capacity of unique codes for use in the beverage can industry. The present invention is not intended to be limited by the particular combinations set out in the specification. Rather, the claims are intended to define the scope of the invention.

The method for marking a code on a beverage can tab structure includes forming a two dimensional code on a surface on a body portion of the beverage can tab structure, which encompasses both marking the tab after it is formed in a tab press and marking the tab stock before it enters the tab press. The elements of the code preferably are formed in a coating that is dark by applying an approximately round laser light forming spots. The term round is used herein to refer to approximately circular at the plane (that is, the metal surface) on which the light is projected (that is, the spots). The spots preferably are formed one at a time such that the laser remains stationary until the spot is formed. Then, after forming a spot, the laser is moved and/or the tab structure is moved to another desired location for forming another spot. More than one laser may be used to form more than one spot at a time. The process is repeated until the desired code is formed.

The laser light preferably disturbs the coating, thereby forming light-colored spots that are approximately round and have a minimum diameter of at least 200 microns. The spots form a two dimensional code, preferably a Data Matrix Code, that is readable by a wireless communication device. Preferably the code area is less than 6 mm by 6 mm.

Consumer scannable codes of less than 6 mm square are conventionally problematic and are not currently used commercially in the beverage can industry because, the inventors surmise, two dimensional codes (especially QR codes, which is the most popular version used in packaging) have a resolution that is too fine to read reliably when placed in the small available area of commercial tabs, according to the conventional wisdom that a small code requires high resolution to achieve a high number of unique combinations of elements. In some circumstance using some embodiments of the disclosure, a custom app having built-in scanning software for a smartphone may be required.

The present invention is not limited to the 6 mm by 6 mm code size limit unless the limit is expressly set out in the claims. The code is preferably read within the given process time target of approximately 50 ms.

Thus, in some embodiments, a DMC code that is scannable by conventional wireless communication devices (regardless whether using conventional or customized scanning apps) enables a quantity of possible codes that is large enough to create a unique ID for the beverage can market.

Conventional codes require a quiet zone, thus would make the available space even smaller on the tab recess. Accordingly, an inverted code (that is, forming light colored elements on a dark background) enables the use of a code using the background surrounding the code as the quiet zone.

Another embodiment of the present disclosure provides an unseamed beverage can end comprising a shell and a tab. The shell including a curl, a sidewall, a center panel, and a score in the center panel for forming a tear panel. The tab is attached to the center panel by a rivet. The tab includes a body portion that has a surface. The surface has a coating that is dark; and a marking code on the coating. The marking code is a plurality of light spots achieved by a round laser light. Each of the plurality of light spots has a minimum dimension of at least 200 microns. The plurality of light spots forms a two dimensional code that is readable by a wireless communication device.

BRIEF DESCRIPTION OF THE FIGURES

FIG. 2 is an image of tab stock formed into ends illustrating aspects of the present invention.

FIG. 3 is an image of a two dimensional code illustrating an aspect of the present invention.

FIG. 4 are images of spots of a code formed according to an aspect of the present invention.

DETAILED DESCRIPTION OF PREFERRED EMBODIMENTS

Figure 1A:
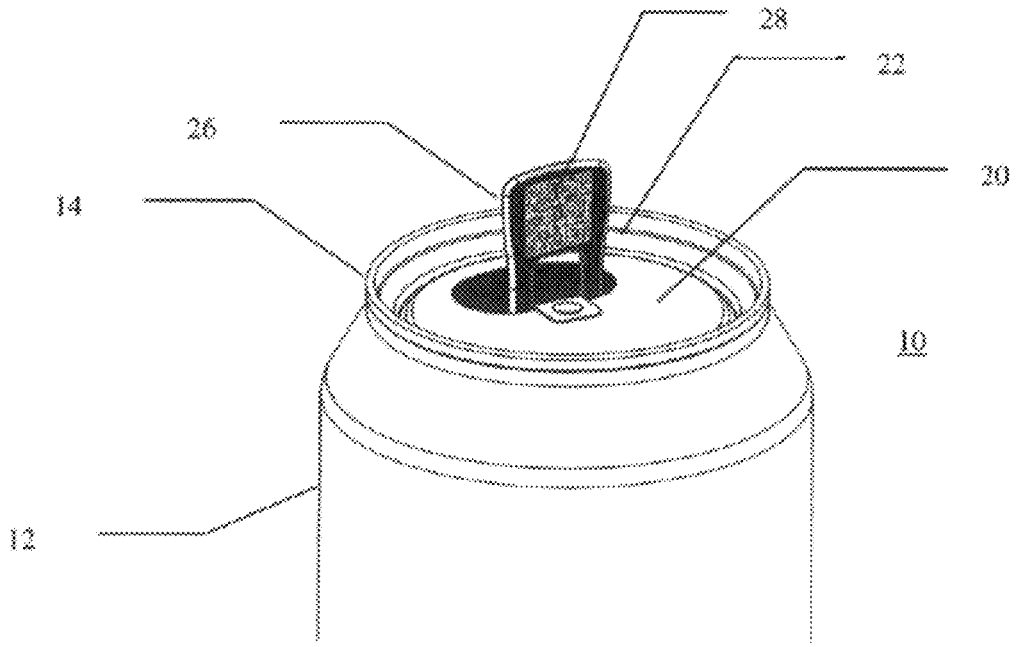
FIG. 1A is a perspective and schematic view of an end having a two dimensional code on the tab.

FIG. 1A schematically illustrates a beverage can 10 that includes a can body 12 and a can end 14. The can end 14 may be seamed, as illustrated, or unseamed. An unseamed can end is disclosed in U.S. Pat. No. 9,187,221, entitled "Can Ends Having Machine Readable Information," filed on Sep. 27, 2012, the content of which is incorporated herein by reference. End 14 includes a center panel 20 and a chuck wall 22. The finished end also includes a pull tab 26 attached to the center panel 20 by a rivet. The pull tab 26 is shown in its fully actuated position after it has ruptured the score to create the pour opening. An image, such as a two dimensional code 28, is located on the underside of tab 26 such that it would be visible only after actuation of tab 26. The present invention is not limited to beverage can ends, but encompasses other ends, such as ends on food cans.

The tab on which the code is applied includes a nose, a heel, and a structural body between the nose and the heel. The structural body has a land through which a rivet can be attached to affixed the tab 26 to a beverage can. As shown, code 28 is formed directly on the structural body of tab 26.

Figure 1B:
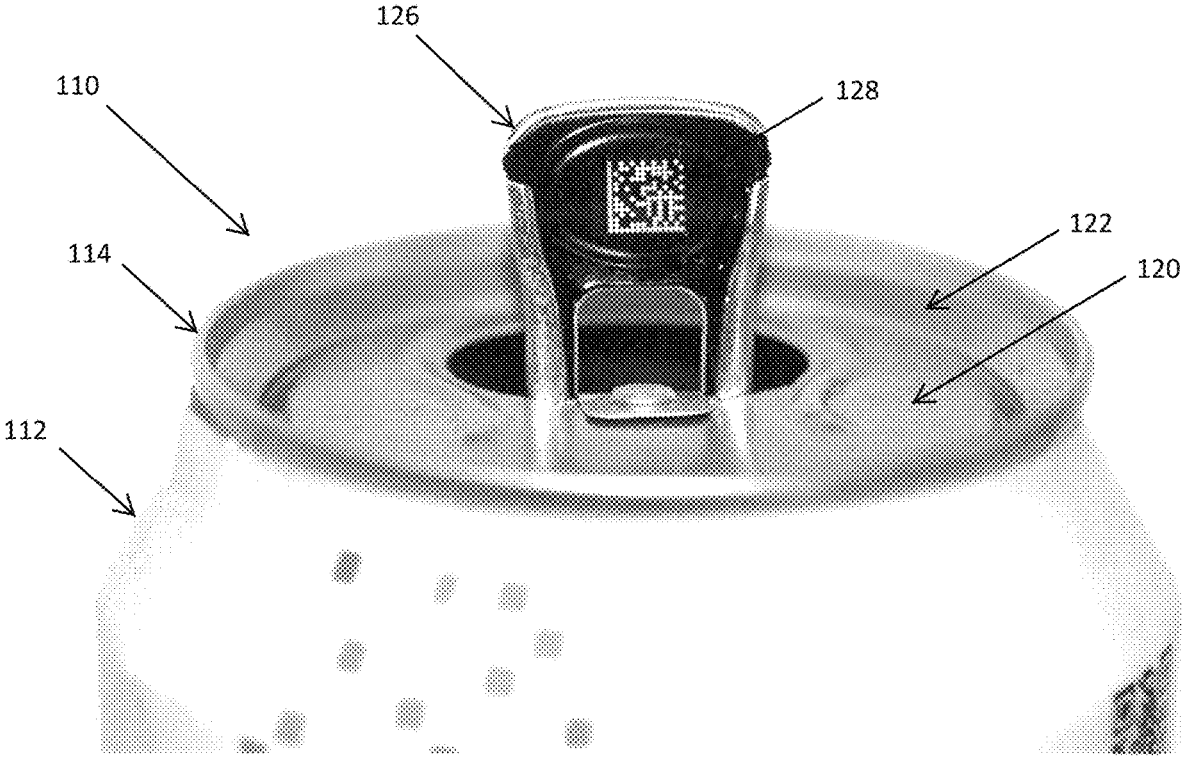
FIG. 1B is a perspective image of an end having a preferred embodiment code.
Figure 1C:
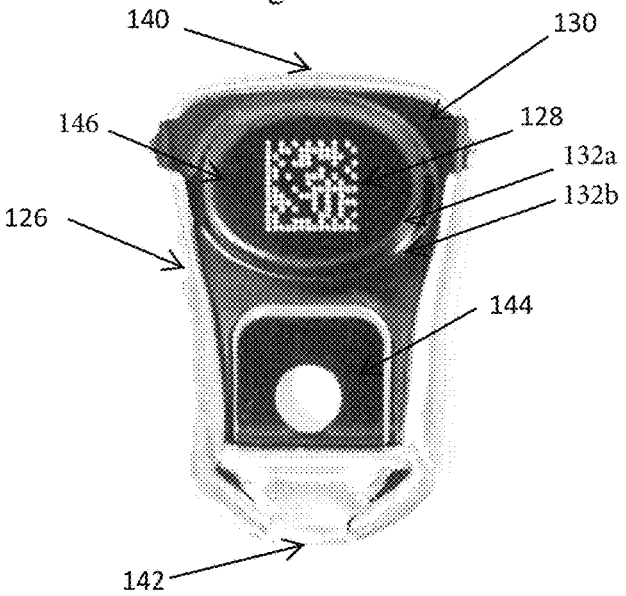
FIG. 1C is a bottom image of a tab having a two dimensional code.

Code 28 can be any two dimensional code capable of being read by a scanner or wireless communication device, such as an app for a commercial smartphone. The code may be of any type such as an Aztek code, a MaxiCode, a QR code, or, as illustrated in FIGS. 1B, 3, and 4, a Data Matric Code ("DMC"). Each of these codes is governed by standards, which a person familiar with code technology will understand.

As illustrated in FIG. 1B, a preferred embodiment includes a beverage can 110 that includes a can body 112 and a seamed can end 114. End 114 includes a center panel 120 and a chuck wall 122. The finished end also includes a pull tab 126 attached to the center panel by a rivet. The pull tab 126 is shown in its fully actuated position after it has ruptured the score to create the pour opening. A code 128 is located on the underside of tab 126 such that it would be visible only after actuation of tab 126.

Tab 126 includes a heel 140, a nose 142 (shown as underneath center panel 120 in the figures because tab 126 is in its actuated position after opening a tear panel), a rivet island 144, and a panel 146. Tab 126 is actuated in a conventional way by lifting heel 140 to pivot the tab about the rivet such that nose 142 presses down on the tear panel.

Panel 146 is continuous or hole-less and flat to provide a substrate that is approximately 6 mm by 6 mm or less, with a tolerance of plus/minus 0.5 mm, which is helpful for positioning code 128. Thus, panel 146 is flat, which is used herein to mean conventionally flat and sufficient for efficient reading of codes by conventional, retail wireless communication devices, such as an iPhone 6 and the like including corresponding conventional scanning software or applications.

As illustrated in FIG. 1B, panel 146 preferably is recessed or set off from a curled portion of the tab 126 and from an upper flat portion 130 by a pair of ledges or steps 132*a* and 132*b*. Panel portion 146, which bears code 128, and upper panel portion 130 form a continuous and hole-less surface between the curl portion of the tab 126 at the heel 140 and a cutout for rivet island 144.

The inventors have determined that DMC codes are preferred for marking tabs because of efficiency of data storage relative to space available under the tab. Code 128 in FIG. 1B is a Data Matric Code ("DMC"), which is a two-dimensional matrix barcode consisting of black and white cells or modules arranged in either a square or rectangular pattern. Each module represents a bit, which can be encoded can be text or numeric data. DMC codes typically include two solid adjacent borders in an "L" shape, referred to a finder pattern, and two other borders consisting of alternating dark and light modules, referred to as a timing pattern. DMC codes may be governed by ISO/IEC standards, as will be understood by persons familiar with code technology.

A DMC code type also enables, or makes more effective, reading the code 128 on tab 126, in part because of its high redundancy of about 50% and error checking associated with DMC codes. The inventors have demonstrated that a DMC code can be produced at commercial production speed (that is, commercial speed) of sufficient quality to be reliably read by conventional smartphone cameras and the associated scanning software. The inventors surmise that other code types may be possible.

As shown in the figures, DMC code 128 is a 14 by 14 two dimensional matrix of silver or light spots on a black background, which matrix is surrounded by the black coating. The spots as shown do not overlap. As best shown in FIG. 4, the coating is disturbed to form a silver or light color. In some circumstances the coating is not removed from the metal substrate, which metal substrate preferably is not ablated or altered by the lasering process. Preferably, the code 128 is at least a 12 by 12 element size and less than a 21 by 21 element size. The lower limit enables sufficient combinations of elements for use in the vast quantities common for beverage cans. The upper limit provides a sufficient dot size to enhance the ability for reading.

The method for forming code 128 can be applied to any tab structure. The term "tab structure" is used to refer to tab stock in a flat strip as it comes off the roll before it enters the tab press, finished tabs after exiting the tab press, and tabs after exiting the conversion press such that the tabs are affixed to commercial beverage ends. FIG. 4 shows tabs in the state after the conversion press, which tabs are attached to a skeleton or remnant of the strip.

The spots preferably are formed by disturbing the dark coating. The inventors have demonstrated that a black lacquer coating can be disturbed such that it changes color or brightness. A laser having fluence that is too low to cause vaporization, at least in the time intervals described herein, can be employed. In this regard, the black coating absorbs the 1 micron laser wavelength common to fiber lasers. Coatings other than black can be employed so long as the coating is capable of absorbing 1 micron laser wavelengths in order to change color or brightness as described here. Further, other coatings that absorb other wavelengths, for example (without limitation) 10 micron wavelengths of CO2 lasers, may also be employed.

The term "dark coating" is used herein to describe a black coating, and also encompasses other coatings that provide a sufficient change in color or brightness to appear to be a light spot relative to the coating when laser light is applied. Whether a coating constitutes a "dark coating" that can change color upon absorbing laser light of a given wavelength can be ascertained by routine experimentation in view of the present disclosure.

Code 128 is an inverted code such that it is formed by light spots on a dark background, rather than the conventional black squares on a white background. Conventional DMC codes require a 3 module wide white quiet zone around the code, but because the code is inverted the black coating itself forms the quiet zone.

Tabs 126 preferably are laser marked just prior to the conversion press during the portion of the cycle when the parts are stationary. At a tab making production speed of at least 650 ends per minute, with three lanes and one laser per lane, the stationary period is approximately 55 milliseconds (ms). Accordingly, code 128 preferably is applied in less than 75 ms, and more preferably less than 65 ms, and preferably less than 55 ms to form the two dimensional code. Providing a unique code to each of 10 billion cans, which chances of guessing a code at random is very small preferably dictates, at least a 12 by 12 module code.

The method of forming code 128 includes forming spots having an appropriate size at an appropriate speed. Code 128 is formed of spots having a diameter of at least 200 microns, preferably 250 to 400 microns, and more preferably between 250 and 350 microns. In the embodiment, the spots are approximately 330 microns. In circumstances in which the spots are not round, the diameter values may be calculated by averaging the minimum and maximum dimensions through the geometric center of the spot to produce an average spot diameter.

To aid in reading, the spots preferably have an aspect ratio, which is defined as the ratio of the maximum dimension and minimum dimension of the spot taken through its geometric center, of no more than approximately 1.5, more preferably no more than approximately 1.3, and more preferably no more than approximately 1.2.

The laser employed has a focal ratio of between approximately 40 and approximately 70, more preferably between approximately 45 and approximately 65 and even more preferably approximately 50 and approximately 60 which values the inventors believe are relatively larger than those for conventional laser marking processes and provide a relatively large diameter large spot (described above) and good tolerance to out of focus errors. The "focal ratio" is the focal distance divided by the beam diameter measured at the final lens. The focal distance preferably is greater than 225 mm, more preferably, greater than 275 mm, more preferably between 300 and 375 mm, and for the embodiment shown approximately 330 mm.

The laser employed to produce the spots of code 128 in FIGS. 2 through 4 is a 70 W, H-type fiber laser supplied by SPI Lasers under the tradename RedEnergy G4. The inventors surmise that a laser power of 40 W or greater may be used. As a general rule, obtaining or seeking a uniform beam intensity profile is achieved in a specific plane. To achieve the spots of code 128 at commercial speeds, the beam has a "depth of field" attribute such that a perfect intensity distribution (that is a "top-hat" distribution) across the beam is not feasible. Accordingly, the laser in the examples is adjusted to be appropriately out of focus and includes optical aberration to obtain the desired beam attributes, including uniformity of intensity. In this regard, aberration and focus are used to create a wider, more uniform distribution, as will be understood by persons familiar with laser technology for marking. In the examples, several short high energy pulses, for example six, are used to progressively disturb the lacquer to achieve the desired effect. The laser is applied without active focusing or feedback.

Figure 5A:
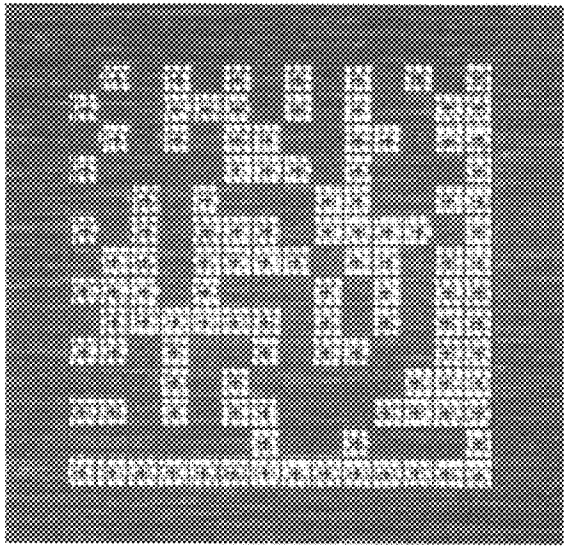
FIGS. 5A and 5B are images of a code that is formed by spots, wherein each element is formed by multiple spots.
Figure 5B:
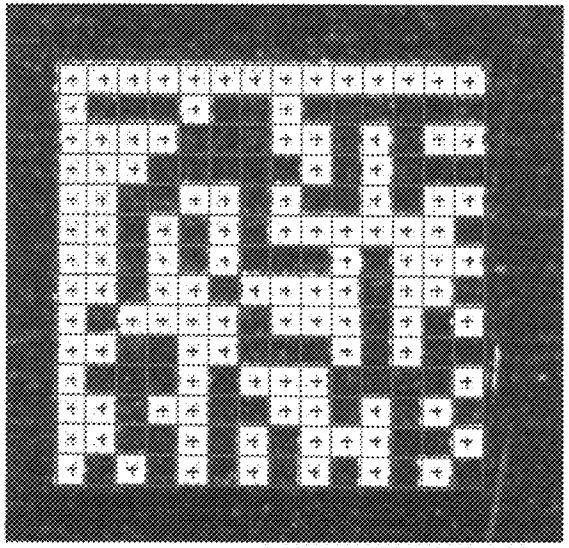

Alternatively, as illustrated in FIGS. 5A and 5B, each element can be formed by several spots. In the embodiment shown, nine dots are formed by a laser to fill produce an element that can be read by a wireless communication device, as described above. Each of the multiple spots may be discrete, such that each spot does not overlap with adjacent spots, as shown in FIG. 5A. Or each of the multiple spots may be formed such that it overlaps adjacent spots within the same element, as shown in FIG. 5B. Each of the spots of FIGS. 5A and 5B may be formed by the lasering process and equipment as generally described herein to achieve elements that are readable by wireless communication devices described herein.

The present invention is illustrated by the code and tab structure described herein. The present invention is not limited to the particular disclosure, but rather encompasses the full range of embodiments as defined by the claims.

The invention claimed is:

1. A method for marking a code on a beverage can tab structure, comprising the steps of:

on a surface on a body portion of the beverage can tab structure having a coating that changes color or brightness to appear lighter upon absorbing laser light when laser light is applied, (i) applying an approximately round laser light onto a first location on the surface at tab making production speed to achieve a light-colored spot when the coating is absorbing the laser light;

after the applying step (i), (ii) repeatedly applying the approximately round laser light onto other locations on the surface on the body portion of the beverage can tab structure to achieve other light-colored spots;

(iii) advancing the tab structure so that steps (i) and (ii) can be repeated for a next tab body portion, steps (i) through (iii) being performed repeatedly in cycles, wherein each cycle is performed within a process time target and the laser light in the applying steps (i) and (ii) changes the color or brightness of the coating, thereby forming the light-colored spots having a minimum dimension of at least 200 microns, the light-colored spots composing elements that form a two dimensional code that is readable by a wireless communication device, wherein the applying steps (i) and (ii) are applied in less than 75 ms to form the two dimensional code; and reading, within the process time target of each cycle, the two-dimensional codes marked on a tab body portion.

2. The method of claim 1, wherein each element is formed from a single spot.

3. The method of claim 2, wherein the applying steps (i) and (ii) are applied in less than 65 ms to form the two dimensional code.

4. The method of claim 2, wherein the applying steps (i) and (ii) are executed without active focusing of the laser.

5. The method of claim 2, wherein the coating is black forming a background surrounding the code as a quiet zone.

6. The method of claim 2, wherein the steps of applying the laser light include employing a laser having a focal ratio of between approximately 40 and approximately 70, or between 45 and 65, or between 50 and 60.

7. The method of claim 6, wherein the code is no greater than 6 mm by 6 mm.

8. The method of claim 6, wherein the code is no greater than 5 mm by 5 mm.

9. The method of claim 6, wherein the spots have an aspect ratio of no more than approximately 1.5.

10. The method of claim 6, wherein the spots have an aspect ratio of no more than approximately 1.2.

11. The method of claim 6, wherein a focal distance is greater than 225 mm.

12. The method of claim 6, wherein a focal distance is between 300 and 375 mm.

13. The method of claim 1, wherein each element is formed from multiple spots, each one of the spots formed by a single application of the laser, each one of the spots being approximately round.

14. The method of claim 1, wherein each of the light-colored spots do not overlap one another.

15. A method for marking a code on a beverage can tab structure, comprising the steps of:

on a surface on a body portion of the beverage can tab structure having a coating that changes color or brightness to appear lighter upon absorbing laser light when laser light is applied, (i) applying an approximately round laser light onto a first location on the surface at tab making production speed to achieve a light-colored spot when the coating is absorbing the laser light;

after the applying step (i), (ii) repeatedly applying the approximately round laser light onto other locations on the surface on the body portion of the beverage can tab structure to achieve other light-colored spots;

(iii) advancing the tab structure so that steps (i) and (ii) can be repeated for a next tab body portion, steps (i) through (iii) being performed repeatedly in cycles, wherein each cycle is performed within a process time target and the laser light in the applying steps (i) and (ii) changes the color or brightness of the coating, thereby forming the light-colored spots having a minimum dimension of at least 200 microns, the light-colored spots composing elements that form a two dimensional code that is readable by a wireless communication device, wherein the applying steps (i) and (ii) are applied in less than 75 ms to form the two dimensional code, and wherein each of the light-colored spots are approximately the same size, and reading, within the process time target of each cycle, the two-dimensional codes marked on a tab body portion.

* * * * *